United States Patent [19]

Kleiner

[11] Patent Number: 4,907,246

[45] Date of Patent: Mar. 6, 1990

[54] MAGNETICALLY CONTROLLED VARIABLE TRANSFORMER

[76] Inventor: Charles T. Kleiner, P.O. Box 17879, Anaheim, Calif. 92817

[21] Appl. No.: 331,967

[22] Filed: Apr. 3, 1989

[51] Int. Cl.[4] ..... G05F 3/06

[52] U.S. Cl. ..... 323/335; 323/338; 323/361

[58] Field of Search ..... 323/249, 251, 253, 329, 323/332, 335, 338, 361; 336/131; 330/8

[56] References Cited

U.S. PATENT DOCUMENTS

| | | | |
|---|---|---|---|
| 3,123,764 | 3/1964 | Patton | 323/338 |
| 3,343,074 | 9/1967 | Brock | 323/338 |
| 4,129,820 | 12/1978 | Brock | 323/361 |

*Primary Examiner*—William H. Beha, Jr.

*Attorney, Agent, or Firm*—Morland C. Fischer

[57] ABSTRACT

A magnetically controlled variable transformer comprising magnetic cores and windings by which to accurately and reliably control electrical AC output power. The cores and windings act as a continuously variable turns-ratio transformer for use primarily at high power frequency applications (e.g. 400 KHz or higher), such as in aircraft and aerospace vehicles. The transformer of the present invention is implemented by coupling a 2-core variable saturable transformer to a fixed turns ratio linear transformer. By varying a DC control current to a DC control winding which is magnetically coupled to the saturable transformer, the AC output voltage at a resistive or reactive load can be varied from zero to full power, whereby the control range of the transformer can be maximized.

13 Claims, 6 Drawing Sheets

MAGNETICALLY CONTROLLED VARIABLE TRANSFORMER

BACKGROUND OF THE INVENTION

1. Field of the Invention

This invention relates to a magnetically controlled transformer including magnetic cores and windings by which AC output power can be accurately controlled by means of a source of DC control current and a DC control winding.

2. Background Art

Examples of previously used magnetic circuits for controlling AC output power are described while referring to the drawings, where FIG. 1 shows a magnetic circuit 1 including a single core saturable reactor 2. Saturable reactor 2 has a winding 4 which is wound around a saturable magnetic core, such that the inductance of winding 4 will vary with the flux density of the magnetic core material. The flux density of the magnetic core material varies over time with an applied AC voltage from a suitable source 6 thereof typically having an applied frequency which ranges from 10 Hz to 10 mHz. Saturable reactor 2 also includes a second winding 8 which is magnetically coupled to the core wound winding 4. Winding 8 usually has more turns than winding 4 so that a voltage or current gain will be produced across a load resistor 10. The second winding 8 is driven by a series connected DC current source 12. In operation, as the DC current from source 12 increases, the impedance or reactance of winding 4 decreases, while the output voltage across load resistor 10 increases. However, the AC voltage from source 6 which appears across winding 4, minus the voltage across load resistor 10, is also applied directly to the coupled winding 8. Thus, the magnetic circuit 1 of FIG. 1 is difficult to control, because the AC voltage which is fed back across winding 8 interferes with the current from source 12. Moreover, the circuit 1 may be unsafe, depending upon the turns ratio of the windings 4 and 8 and the corresponding magnitude of the fed back voltage. That is, if the number of turns on winding 4 is small compared to the number of turns on winding 8 and the voltage from AC source 6 is high, then the output voltage at load 10 is very high and possibly hazardous.

Another magnetic circuit shown in FIG. 1a included the single core saturable reactor of FIG. 1 with an additional winding 15 (sometimes referred to as a flying choke). That is, the additional winding 15, which was not magnetically coupled to either one of the saturable core windings (i.e. designated 4 and 8 in FIG. 1), is connected in series with winding 8 in the DC current path. This extra winding 15 advantageously absorbs some of the fed back AC voltage without affecting output power or control. However, the cost, size and weight of this magnetic circuit was increased because of the inclusion of the additional winding 15. Moreover, and inasmuch as the additional winding 15 had to sustain the fed back voltage, said winding has been known to break down or arc.

A third magnetic circuit 16, including a 2-core saturable reactor 18, is illustrated in FIG. 2 of the drawings. The saturable reactor 18 has two series connected windings 20 and 22 which are wound around respective balanced (i.e. equal inductance) magnetic cores and a third winding 24 which is magnetically coupled to each of the windings 20 and 22 to better absorb the fed back AC voltage. A DC current source 26 is connected in a DC current path to drive the common winding 24. The output voltage across the load resistor 28 of circuit 16 is proportional to the DC current from source 26. Thus, if no DC current is applied to common winding 24, there will be no fed back AC voltage to winding 24. That is, winding 24 cancels the fundamental frequency of AC source 30 resulting in no AC fed back voltage when the DC control current is zero. However, and as a disadvantage, when the common winding 24 is driven by a DC current, the second harmonic (as opposed to the fundamental) of the AC input voltage from source 30 appears across winding 24. The AC output voltage is controlled in a similar fashion to the circuit of FIG. 1, except that two series connected windings 20 and 22 are used which increases the size, weight, and cost of the saturable reactor 18.

A fourth known magnetic circuit represented in FIG. 2a included the 2-core saturable reactor of FIG. 2 with the inclusion of a vacuum tube 31 and a shunt connected capacitor 33. This modified circuit commonly used as AC input voltage operating at approximately 400 Hz and was particularly applicable for aircraft (e.g. for heaters, motors, and regulators). The vacuum tube 31 was added to more reliably control the DC current through the common, magnetically coupled winding (i.e. designed 24 in FIG. 2), while the capacitor 33 protected the vacuum tube 31 from the second harmonic of the fed back voltage. Hence, the gain of this circuit could be maximized to form a power amplifier. However, the added vacuum tube 31 consumed space, was sometimes unreliable and generated heat.

Therefore, it was desirable to eliminate the vacuum tube of FIG. 2*a* but still retain the high gain that was available by means of the aforementioned power amplifier. The foregoing was accomplished by the magnetic circuit 34 of FIG. 3 which included a pair of rectifiers 36 and 38. Each rectifier is shown connected in series with a respective winding 40 and 42 (sometimes referred to as gate windings) that is wound around a core formed from a magnetic material characterized by high permeability. In this manner, the rectifiers 36 and 38 would fire sequentially with the source 44 of AC input voltage, such that the circuit 34 was often referred to a gated magnetic amplifier. The circuit 34 also included a common control winding 46 which is magnetically coupled to each of the windings 40 and 42. A DC current source 48 is connected in a DC current path to drive the common winding 46. In operation, a high output voltage initially appears across the load resistor 50, and a small DC current is needed from source 48 to drive common inductor 46 and thereby control such output voltage. This provides high gain without the vacuum tube of FIG. 2a. More particularly, with no DC control current being applied from source 48, the full input voltage is reflected at the load resistor 50, such that the gated magnetic amplifier of FIG. 3 has been found unsuitable and even hazardous for many applications as a consequence of its normally on state.

With the advent of transistors, a center gated magnetic amplifier became available to produce either pulsed AC or DC output voltage. The corresponding circuit 52 illustrated in FIG. 4 of the drawings included four magnetic cores, eight gate windings, two control windings, and a reset resistor 53. The circuit 52 advantageously avoided the normally on state of the circuit of FIG. 3. However, the problems with center gated magnetic amplifier 52 were its large size and the power that had to be dissipated in the reset resistor 53 to reset the magnetic cores for consecutive firing. Consequently, the efficiency of this circuit was reduced by at least 50 percent, since half of the input power from the AC voltage source is dissipated in reset resistor 53.

FIG. 5 of the drawings shows a relatively recent circuit 54 which eliminated the multiple cores and reset resistor of the aforementioned center gated magnetic amplifier of FIG. 4. The foregoing was accomplished by means of using thyristors or silicon controlled rectifiers (as shown), triacs, etc., instead of magnetic cores. A circuit of this nature was desirable because of its efficiency and relatively small size, inasmuch as there was no longer a need to dissipate power in a reset resistor.

Examples of these and other prior art magnetic circuits are available by referring to one or more of the following U.S. Pat. Nos.:

1,815,516: July 21, 1931
1,910,381: May 23, 1933
2,498,475: Feb. 21, 1950
2,870,397: Jan. 20, 1959
3,087,108: Apr. 23, 1963
3,123,764: Mar. 3, 1964

SUMMARY OF THE INVENTION

In general terms, a continuously variable magnetically controlled transformer is disclosed for applications where voltage, current and/or frequency control is important. The transformer comprises the series connection of a 2-core variable saturable transformer and a fixed turns ratio linear transformer. A DC current path including a DC current source and a DC control winding enables continuous control of a transformed AC input voltage to a resistive or reactive load. The control winding is magnetically coupled to the primary and secondary windings of the saturable reactor. During ideal operation, with zero DC current being applied to the control winding, no AC voltage is applied to the load. As the DC control current increases, the AC voltage is transformed to the load. That is, the DC ampere-turns of the DC control winding translates directly to an equivalent number of AC ampere-turns on the primary and secondary windings of the saturable and linear transformers. Thus, the output voltage at the load will be directly proportional to the DC current in the control winding.

Figure 1:
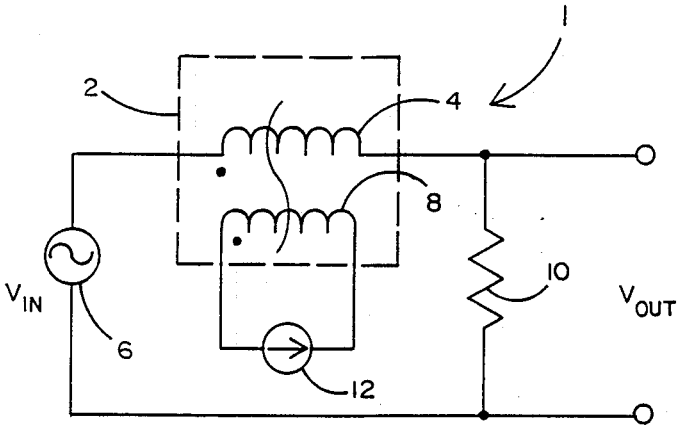
FIG. 1 PRIOR ART
FIGS. 1, 1*a*, 2, 2*a* and 3–5 illustrate prior art circuits for controlling the output voltage from an input AC voltage source.
Figure 1A:
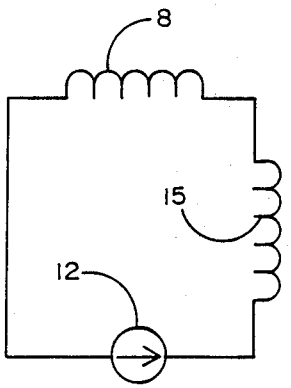
FIG. 1a PRIOR ART
Figure 2:
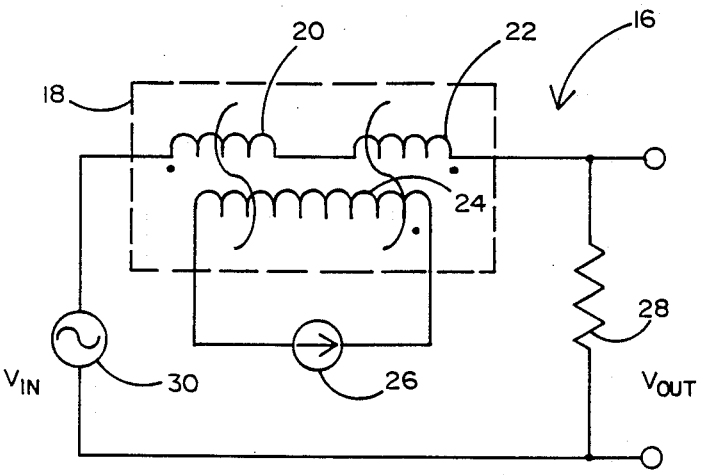
FIG. 2 PRIOR ART
Figure 2A:
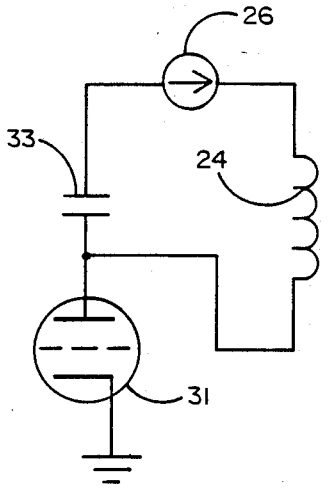
FIG. 2a PRIOR ART
Figure 3:
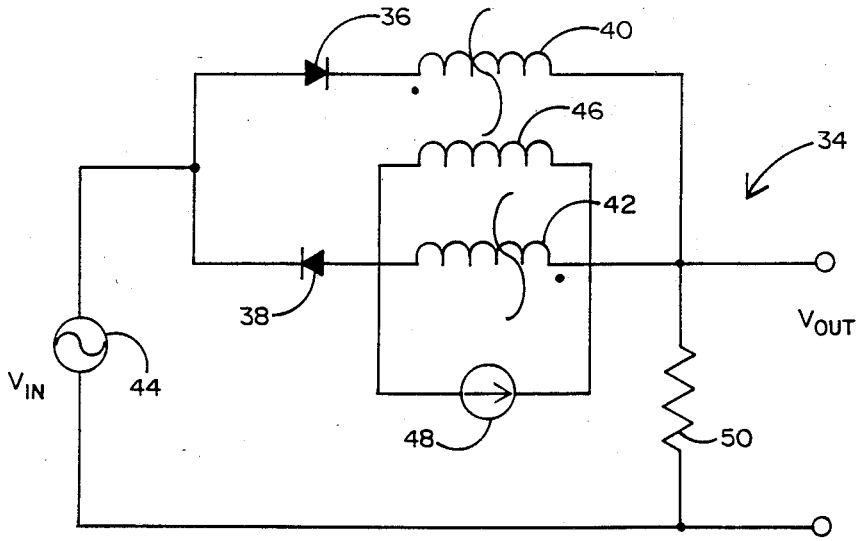
FIG. 3 PRIOR ART
Figure 4:
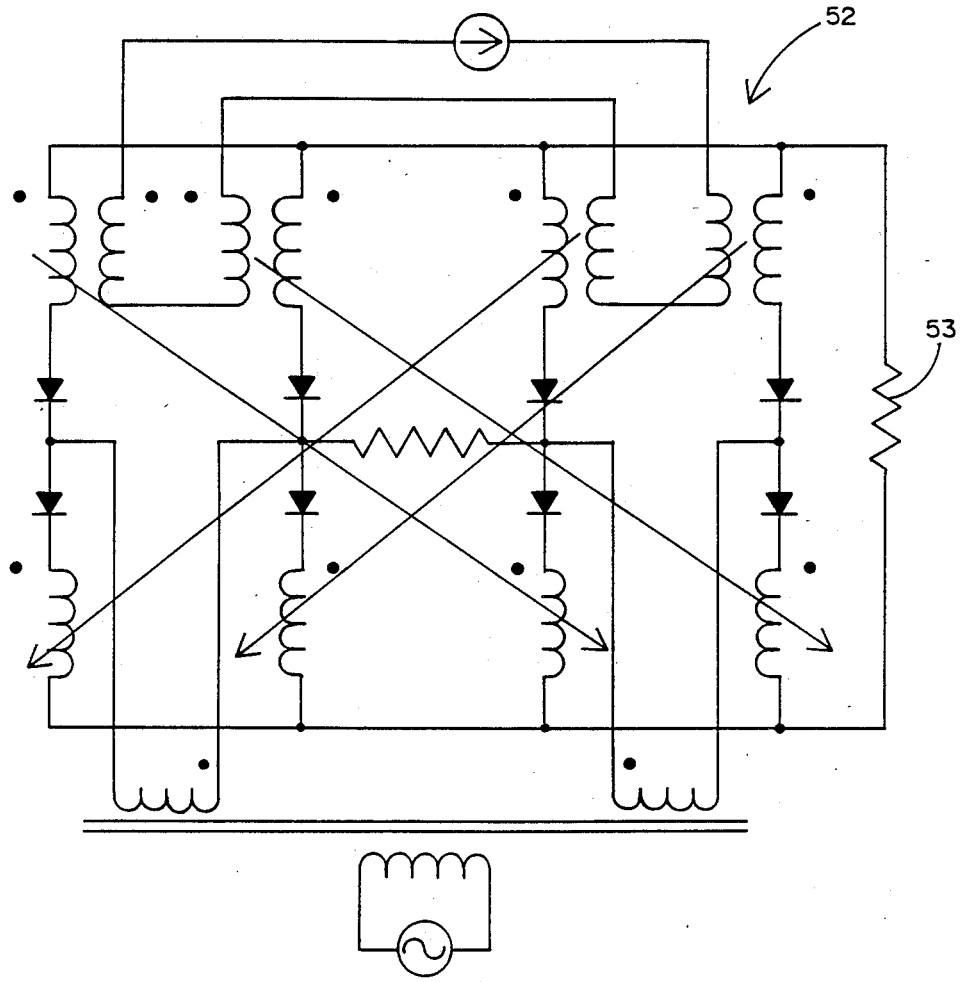
FIG. 4 PRIOR ART
Figure 5:
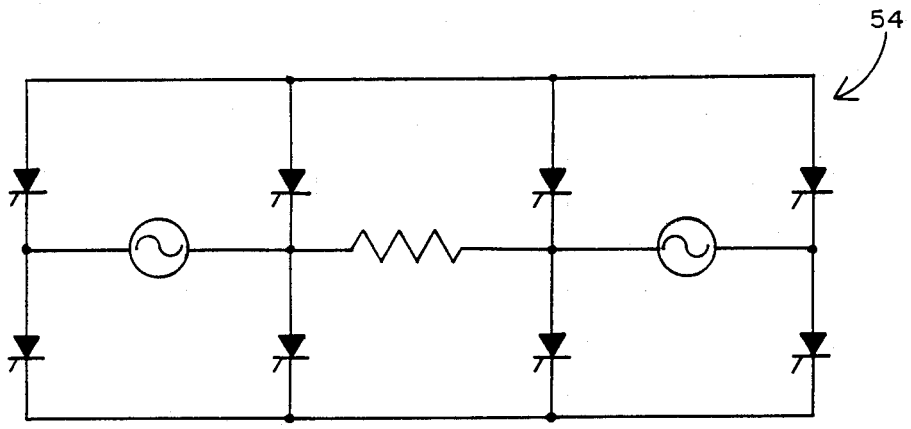
FIG. 5 PRIOR ART
Figure 6:
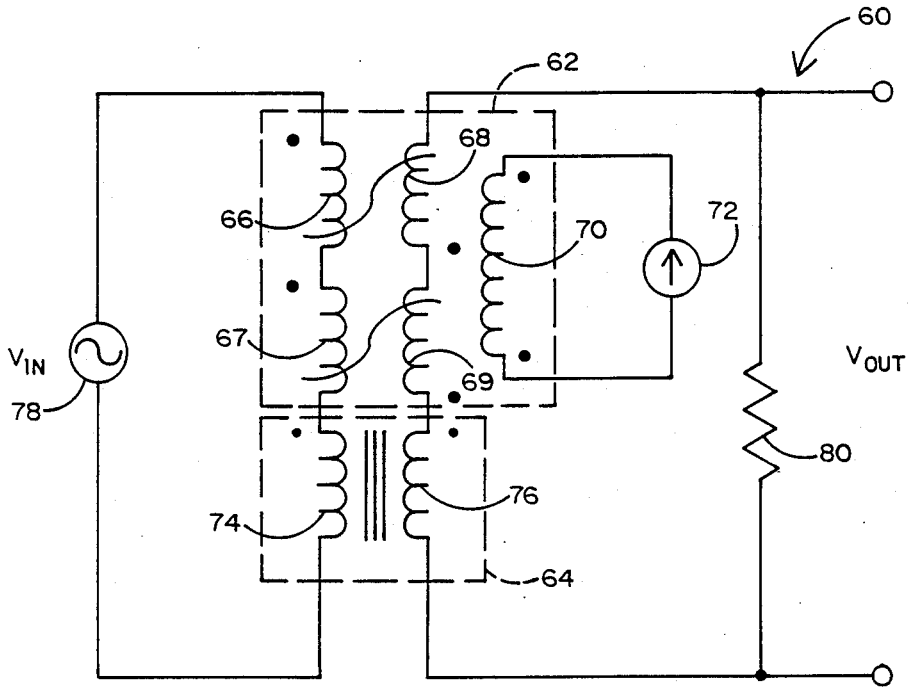
FIG. 6 is a schematic circuit which is illustrative of the magnetically controlled variable transformer which forms the present invention.
Figure 7A:
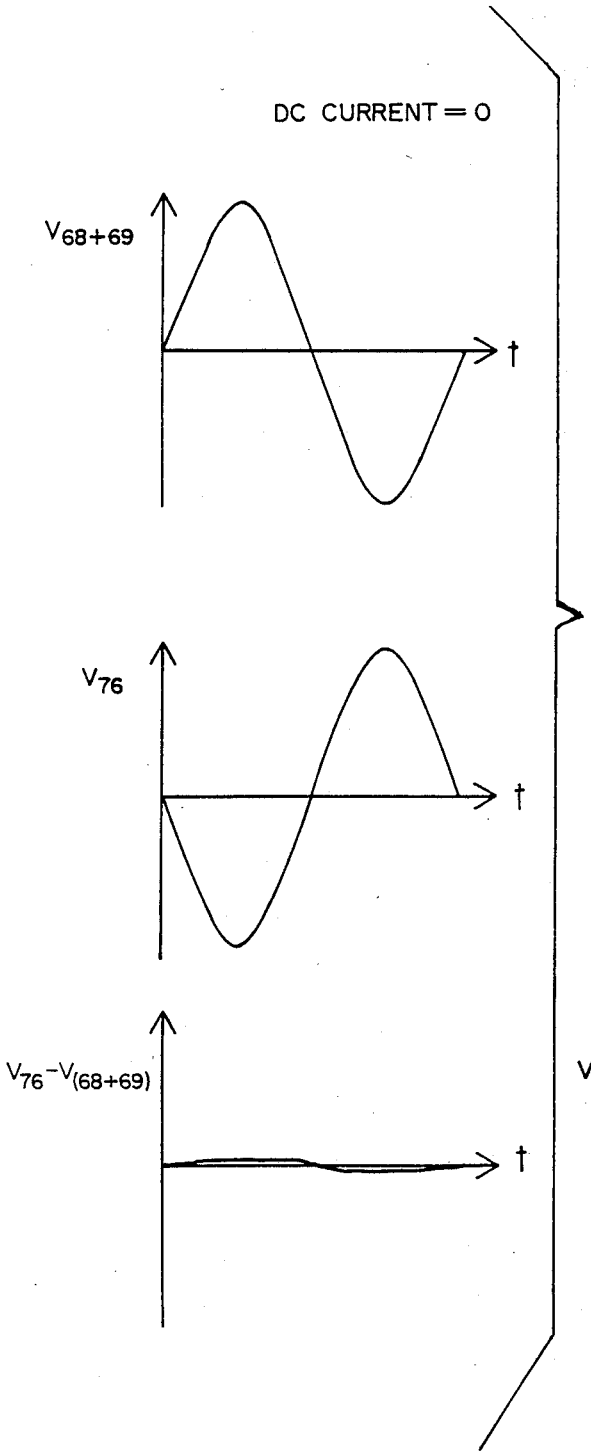
Figure 7B:
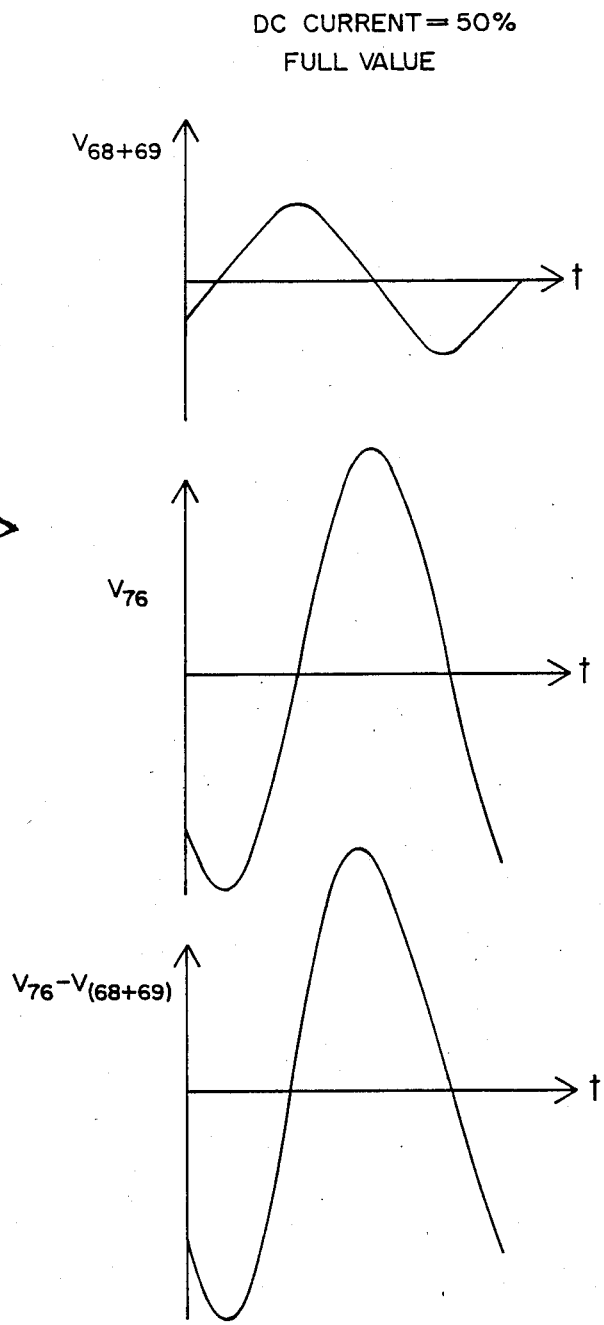
Figure 7C:
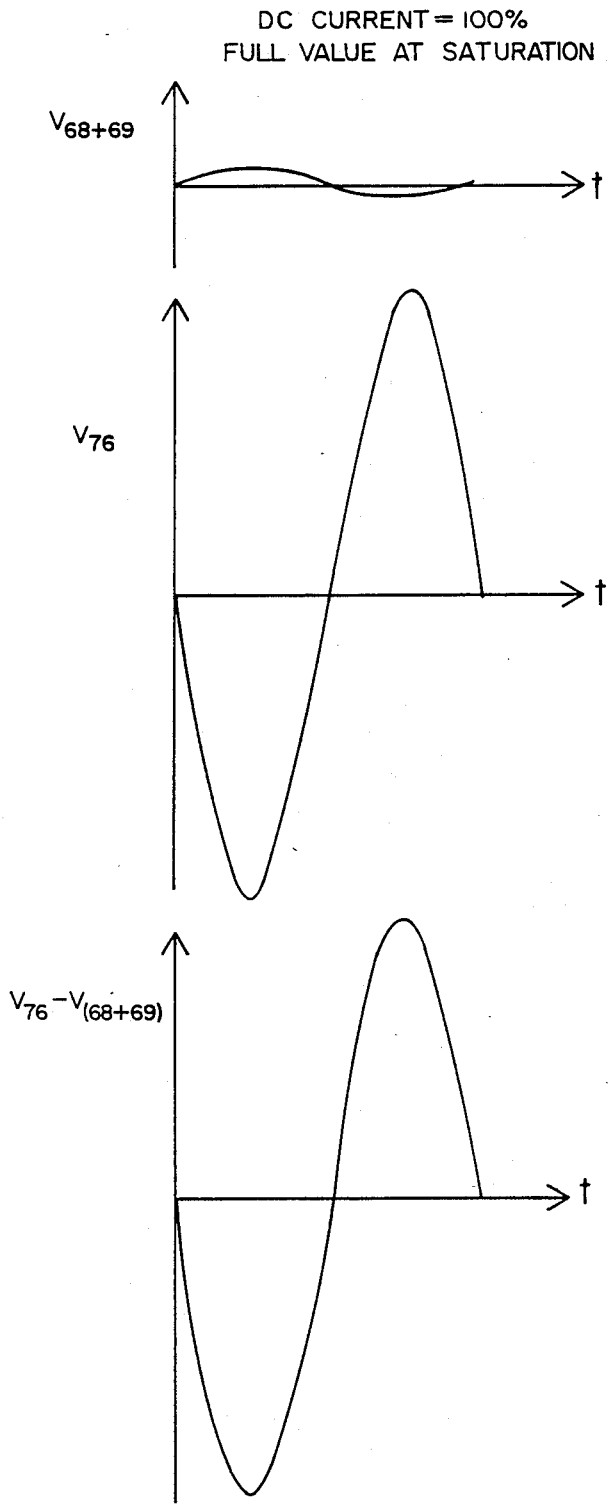

FIG. *7a*, *7b* and *7c* show phase control diagrams for the circuit of FIG. 6 at zero, half and full DC control current.

Figure 8:
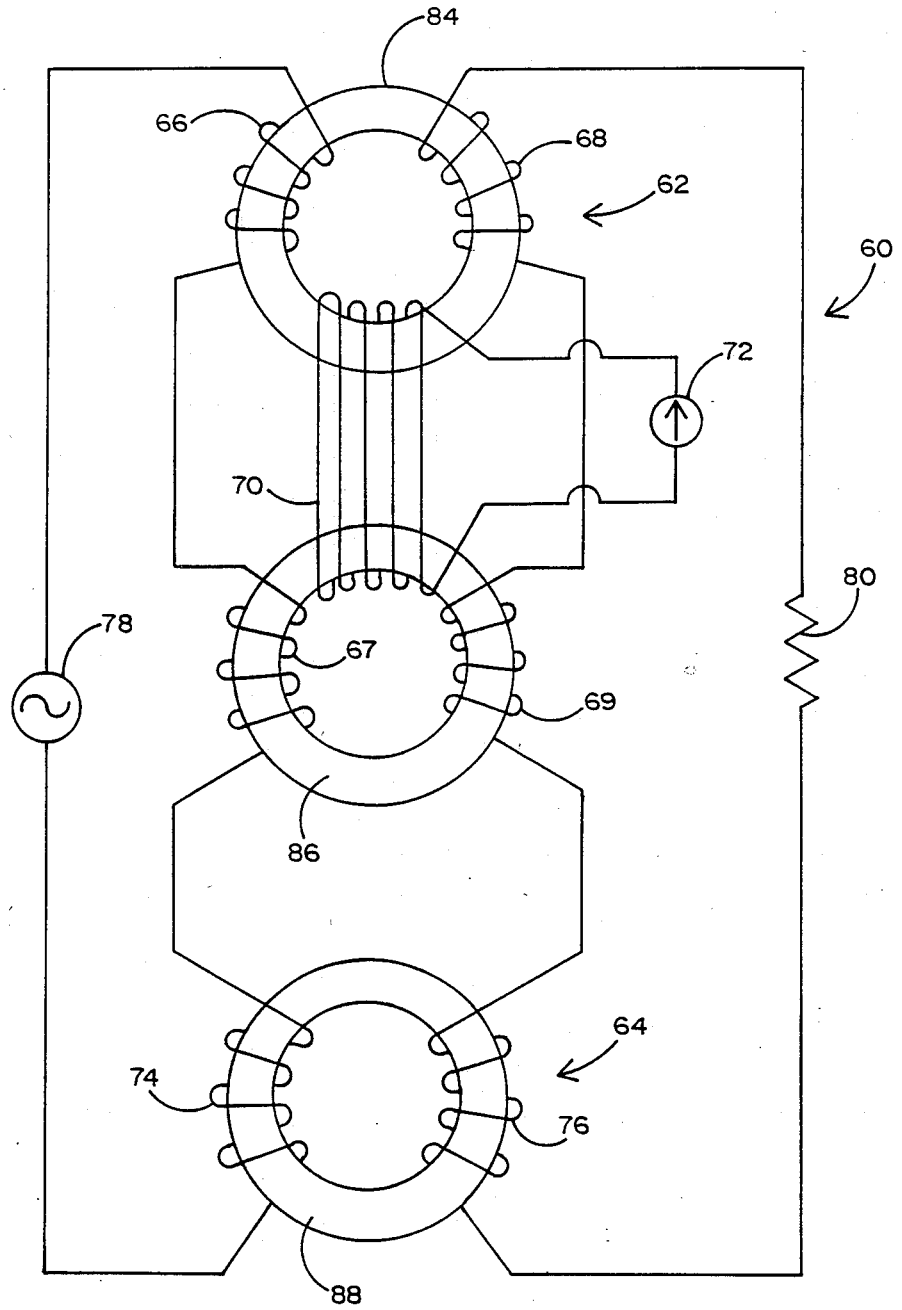

FIG. 8 shows a suitable core configuration by which to implement the transformer of FIG. 6.

DESCRIPTION OF THE PREFERRED EMBODIMENT

A schematic circuit of the magnetically controlled transformer 60 which forms the present invention is illustrated in FIG. 6 of the drawings. The transformer 60 is formed by the interconnection of a 2-core variable saturable transformer 62 and a fixed turns ratio linear transformer 64. The saturable transformer 62 includes primary and secondary pairs of series connected core windings 66, 67 and 68, 69. A common DC control winding 70 is magnetically coupled to each of the windings 66–69. A DC current source 72 is connected in a current path with common winding 70 to supply a DC control current thereto. The linear transformer 64 includes primary and secondary core windings 74 and 76. The magnetically controlled transformer 60 is completed by connecting the primary and secondary windings 67 and 69 of saturable transformer 62 in series with the primary and secondary windings 74 and 76 of linear transformer 64 according to the preferred polarities, as illustrated in FIG. 6.

In operation, an AC voltage is applied from a suitable voltage source 78 to the primary of the magnetically controlled transformer 60. The primary of magnetically controlled transformer 60 includes the series connected windings 66, 67 and 74 from the saturable and linear transformers 62 and 64. The secondary of transformer 60 provides a transformed current to a resistive (or reactive) load 80. The secondary of transformer 60 includes the series connected windings 68, 69 and 76 from the saturable and linear transformers 62 and 64. Thus, the transformed current provided to the load 80 will be proportional to the DC control current applied from current source 72 to the common inductor 70 via the current path therebetween.

The polarities of the windings 66, 67, 68, 69, 74 and 76 are chosen such that the secondary windings 68 and 69 of saturable core transformer 62 are in phase opposition to the secondary voltage of linear transformer 64, so that when the DC control current is zero, no output is applied to load 80. More particularly, the AC voltage from source 78 is divided according to the no load leakage reactance of the magnetic cores of saturable transformer 62. The secondary windings 68, 69 and 76 transform the AC voltage from the primary windings 66, 67 and 74, and the leakage reactance and return ratio can be set such that the net output voltage at load 80 is zero. This avoids the problem of having a large AC voltage initially appear at the load with no DC control current, as has been encountered with at least some of the magnetic circuits of the prior art.

Of course, the polarities of windings 68, 69 and 76 could be chosen so that the respective voltages thereacross add to one another to increase the output voltage at load 80. Moreover, transformer 60 can also be designed with residual output by changing the inductance and turns ratios of transformers 62 and 64.

When the DC control current from source 72 is increased, so as to fully saturate the magnetic cores of saturable transformer 62, a large portion of the input voltage from source 78 is voltage divided across primary winding 74. The DC current through the control winding 70 reduces the reactance of saturable transformer 62 such that the fundamental AC power (i.e. voltage) frequency across transformer 62 approaches zero, and there is no further transformer action between the control winding 70 and the AC primary and secondary windings of the transformer 60. Moreover, and as illustrated in FIG. *7a*, *7b* and *7c* of the drawings, the phase will shift at the series connected secondary windings 68 and 69 of saturable core transformer 62 to maximize the output power delivered to the load 80. That is, the output voltage is controlled by causing a continuous 0 to 90 degree phase shift (following a cosine law) until such phase shift is used up with a residual leakage reactance in the linear transformer 64 and the saturable cores of transformer 62.

According to the laws of energy conservation, the DC ampere-turns of the common inductor 70 translates directly to an equivalent number of AC ampere-turns on the primary and secondary windings of the saturable and linear transformers 62 and 64. The effect of the foregoing compares to an AC current source transforming AC current from the primary to the secondary winding proportional to the DC current in the common control winding 70. The power gain of transformer 60 is calculated by the ratio of AC amperes, squared, delivered to the load 80 to DC amperes, squared, delivered to the common inductor 70. Four cycles of input voltage from AC source 78 are required to execute one power gain cycle. Thus, the power gain of magnetically controlled transformer 60 varies with the transformer design and can be adjusted so that power gains of 50 to 100 are readily obtained. For example, 1 watt of power from current source 72 can control up to 100 watts of power delivered to load 80.

By virtue of the foregoing, the apparent turns ratio of the transformer 60 is automatically and magnetically controlled by a DC control current to regulate AC output power while avoiding the necessity of having to make physical changes to the turns ratio at all frequencies. However, leakage reactance (at saturation) will limit the output power depending upon the core material and winding geometry, although leakage reactance also limits the efficiency of conventional fixed turns ratio transformers. The transformer 60 of this invention is particularly suited for high power frequency applications (e.g. 400 kHz or higher) in aircraft and aerospace vehicles.

FIG. 8 of the drawings show a preferred core configuration for implementing the magnetically controlled transformer 60 of this invention. That is, the two saturable cores 84 and 86 of saturable transformer 62 are shown with their respective primary and secondary windings 66, 67 and 68, 69. The non-saturable core 88 of linear transformer 64 is also shown with its primary and secondary windings 74 and 76. The DC control winding 70 is shown wrapped around and between each of the saturable cores 84 and 86 of saturable transformer 62.

It will be apparent that while a preferred embodiment of the invention has been shown and described, various modifications and changes may be made without departing from the true spirit and scope of the invention.

Having thus set forth a preferred embodiment of the invention, what is claimed is:

1. A magnetically controlled transformer connected between an electrical source and an electrical load by which to controllably apply power from said source to said load, said transformer comprising:

a variable saturable transformer having primary and secondary windings;

a fixed turns ratio linear transformer having primary and second windings, the primary and secondary windings of said saturable and linear transformers being respectively connected with one another in electrical series;

a DC control winding coupled magnetically to said saturable transformer; and a DC current source connected to said DC control winding for driving said winding, such that the output power of said magnetically controlled transformer to said load is directly related to the DC current supplied from said current source to said control winding.

2. The magnetically controlled transformer recited in claim 1, wherein said electrical source is a source of AC voltage such that the output of said transformer to said load is a voltage that is controlled by varying the DC current from said current source to said DC control winding.

3. The magnetically controlled transformer recited in claim 1, wherein said saturable transformer includes a pair of saturable cores each having a primary and secondary winding, the primary and secondary windings of said saturable cores being respectively connected with one another in electrical series.

4. The magnetically controlled transformer recited in claim 3, wherein said DC control winding is wound between the pair of saturable cores of said saturable transformer.

5. The magnetically controlled transformer recited in claim 3, wherein the polarities of the primary windings of said saturable cores are in phase with one another and the polarities of the secondary windings of said saturable cores are in phase with one another, the polarity of said DC control winding being in phase opposition with the polarities of said primary and secondary windings.

6. The magnetically controlled transformer recited in claim 3, wherein said linear transformer includes at least one primary winding and one secondary winding, the primary windings of said saturable and linear transformers being connected together in electrical series to form the primary winding of said magnetically controlled transformer, and the secondary windings of said saturable and linear transformers being connected together in electrical series to form the secondary winding of said magnetically controlled transformer.

7. The magnetically controlled transformer recited in claim 6, wherein the output power of said transformer to said load is proportional to the voltage across the secondary winding of said linear transformer minus the sum of the voltages across the secondary windings of said saturable transformer.

8. A magnetically controlled transformer connected between an electrical source and an electrical load to controllably apply power from said source to said load, said transformer comprising:

saturable core means having primary and secondary windings;

non-saturable core means having primary and secondary windings, the primary winding of each of said saturable and non-saturable core means being connected with one another in electrical series to form the primary winding of said magnetically controlled transformer, and the secondary winding of each of said saturable and non-saturable core means being connected with one another in electrical series to form the secondary winding of said magnetically controlled transformer;

a DC control winding magnetically coupled to said saturable core means; and a DC current source connected to said DC control winding, such that the output of said transformer to said load is directly related to the DC current supplied from said current source to said control winding.

9. The magnetically controlled transformer recited in claim 8, wherein said saturable core means includes a pair of saturable cores each having a primary and secondary winding, the primary and secondary windings of said saturable cores being respectively connected with one another in electrical series.

10. The magnetically controlled transformer recited in claim 9, wherein said DC control winding is wound between said pair of saturable cores.

11. The magnetically controlled transformer recited in claim 8, wherein said saturable core means is a variable saturable transformer.

12. The magnetically controlled transformer recited in claim 8, wherein said non-saturable core means is a fixed turns ratio linear transformer.

13. A magnetically controlled transformer connected between an electrical sourse and an electrical load to controllably apply power from said source to said load, said transformer comprising:

first and second saturable cores, each of said cores having a primary and a secondary winding, the primary and secondary windings of said cores being respectively connected with one another in electrical series;

a non-saturable core having a primary and secondary winding, the primary windings of said saturable and non-saturable cores being interconnected with one another in electrical series to form the primary winding of said magnetically controlled transformer, and the secondary windings of said saturable and non-saturable cores being interconnected with one another in electrical series to form the secondary winding of said magnetically controlled transformer;

a DC control winding coupled magnetically to and wound between said saturable cores; and a DC current source connected to said DC control winding for driving said winding, such that the output of said transformer to said load is directly related to the magnitude of the DC current supplied from said current source to said control winding.

* * * * *